US008069771B1

(12) United States Patent
MacDougall

(10) Patent No.: US 8,069,771 B1
(45) Date of Patent: Dec. 6, 2011

(54) ACTIVE ARMOR SYSTEMS

(75) Inventor: Frederick W. MacDougall, San Diego, CA (US)

(73) Assignee: General Atomics, San Diego, CA (US)

( * ) Notice: Subject to any disclaimer, the term of this patent is extended or adjusted under 35 U.S.C. 154(b) by 0 days.

(21) Appl. No.: 12/891,599

(22) Filed: Sep. 27, 2010

Related U.S. Application Data

(62) Division of application No. 11/507,205, filed on Aug. 11, 2006, now Pat. No. 7,819,050.

(60) Provisional application No. 60/479,976, filed on Aug. 18, 2005.

(51) Int. Cl.
*F41H 11/00* (2006.01)

(52) U.S. Cl. ..... 89/36.17; 89/36.01; 89/36.02; 89/36.07; 89/36.08; 428/911

(58) Field of Classification Search ..... 89/36.17, 89/36.01, 36.02, 36.07, 36.08; 428/911
See application file for complete search history.

(56) References Cited

U.S. PATENT DOCUMENTS

| | | | |
|---|---|---|---|
| 3,893,368 | A | 7/1975 | Wales, Jr. |
| 4,545,286 | A | 10/1985 | Fedij |
| 5,012,721 | A | 5/1991 | Medin et al. |
| 5,402,704 | A | 4/1995 | Donovan |
| 5,442,517 | A | 8/1995 | Yen et al. |
| 6,021,703 | A | 2/2000 | Geiss et al. |
| 6,128,999 | A | 10/2000 | Sepp et al. |
| 6,211,684 | B1 | 4/2001 | McKee et al. |
| 6,327,955 | B1 | 12/2001 | Kerdraon et al. |
| 6,758,125 | B1 | 7/2004 | Zank |
| 6,782,793 | B1 | 8/2004 | Lloyd |
| 7,099,141 | B1 | 8/2006 | Kaufman et al. |
| 7,104,178 | B1 | 9/2006 | Zank |
| 2004/0118273 | A1 | 6/2004 | Zank |
| 2006/0012375 | A1 | 1/2006 | Kelsey et al. |
| 2006/0071640 | A1 | 4/2006 | McCool et al. |
| 2006/0196350 | A1 | 9/2006 | Bouet |
| 2007/0258190 | A1 | 11/2007 | Irwin et al. |
| 2008/0180875 | A1 | 7/2008 | Biggs et al. |

*Primary Examiner* — Michelle Clement
(74) *Attorney, Agent, or Firm* — Fitch Even Tabin & Flannery

(57) ABSTRACT

An improvement in an electric armor system designed to prevent, among other things, a rocket-propelled grenade (RPG) from penetrating the hull of a fighting vehicle. The system includes a self-clearing electrode that will make the system less vulnerable to non-plasma objects that might otherwise short out the active armor electrodes. It optionally further allows for the early initiation of current flow at the point of penetration making it even easier to defeat incoming threats by allowing more time to break-up an incoming plasma jet.

11 Claims, 5 Drawing Sheets

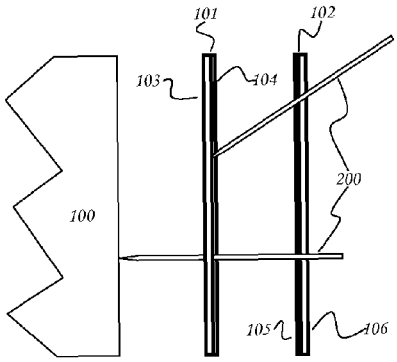
Figure $2_a$
Prior Art
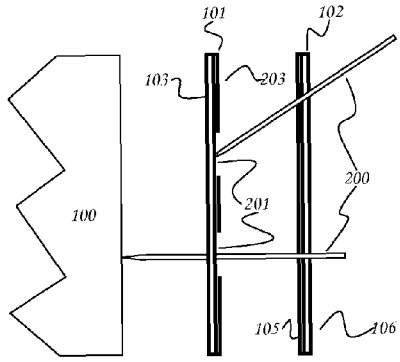
Figure $2_b$
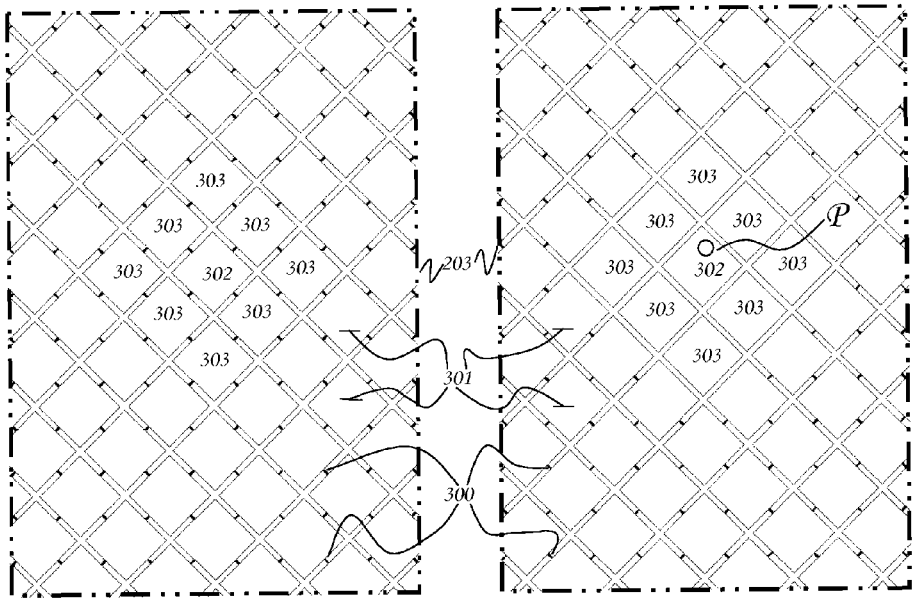
Figure $3_a$
Figure $3_b$

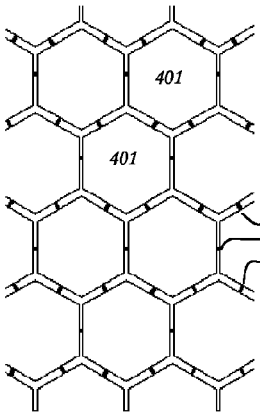
Figure $4_a$
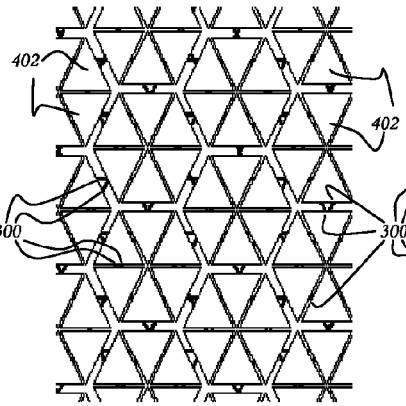
Figure $4_b$
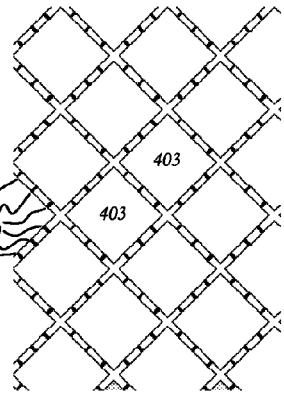
Figure $4_c$
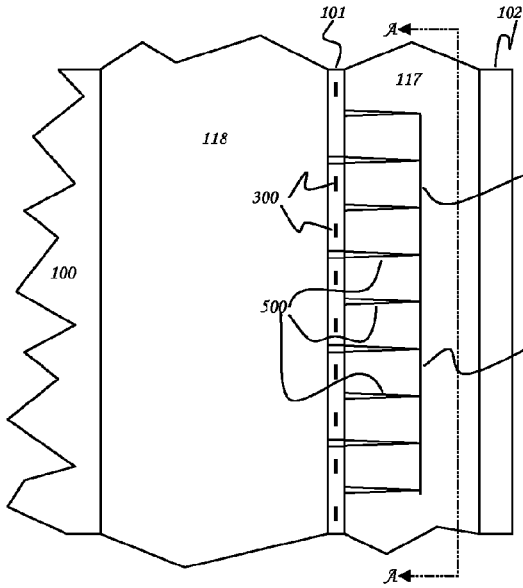
Figure $5_a$
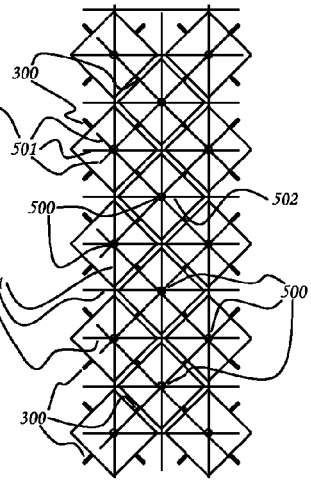
Figure $6_a$

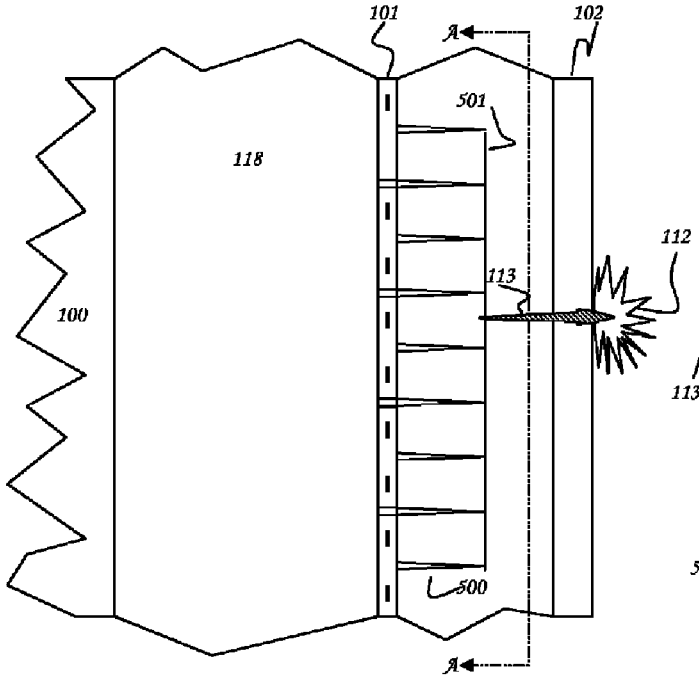
Figure $5_b$
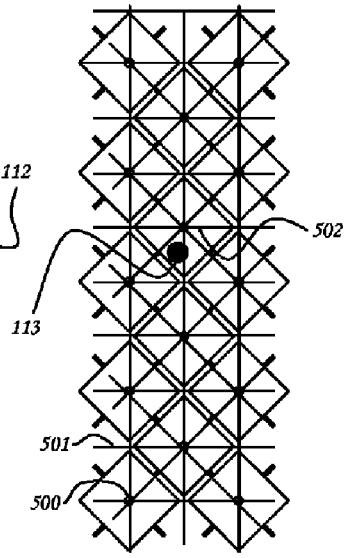
Figure $6_b$
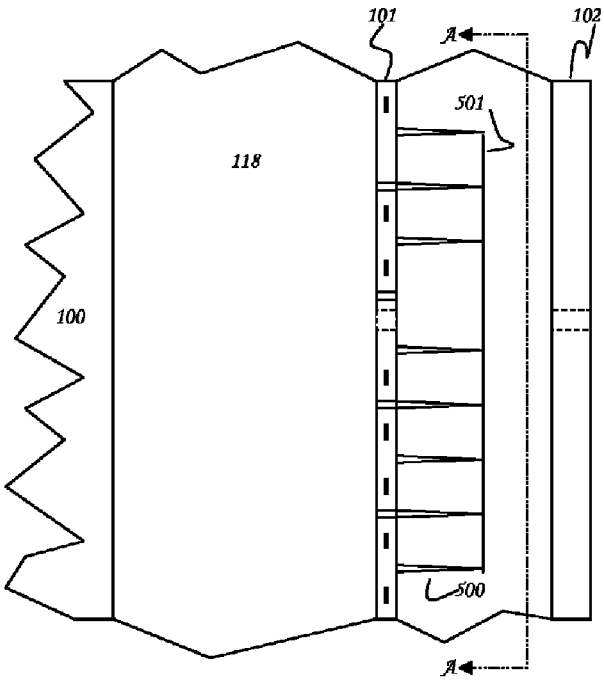
Figure $5_c$
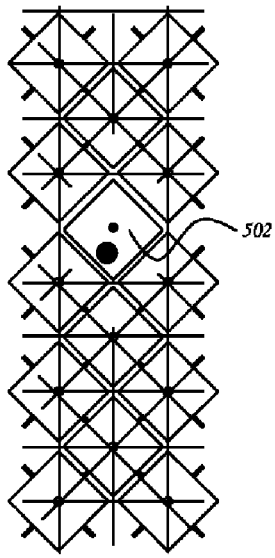
Figure $6_c$

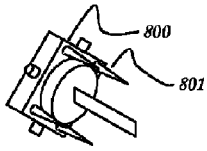
Figure $8_a$
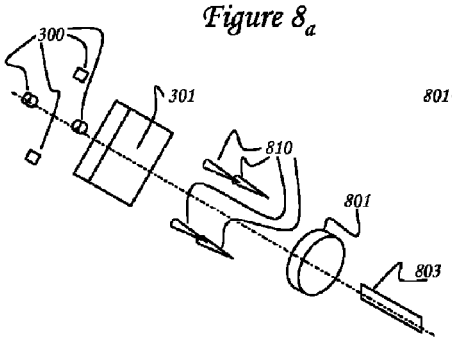
Figure $8_b$
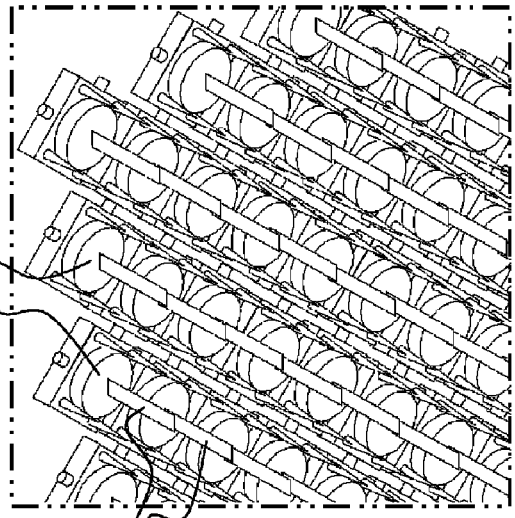
Figure $8_c$
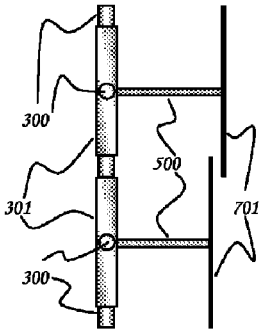
Figure $7_a$
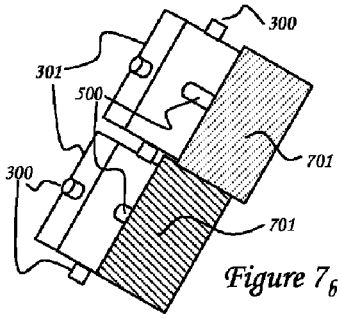
Figure $7_b$
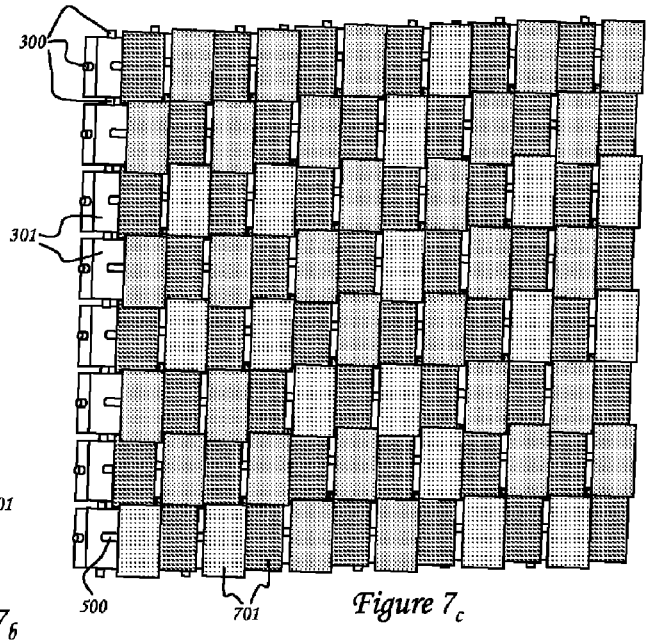
Figure $7_c$

ACTIVE ARMOR SYSTEMS

CROSS REFERENCE TO RELATED APPLICATIONS

This application is a division of U.S. application Ser. No. 11/507,205, filed Aug. 11, 2006, which claims priority from U.S. Provisional Application No. 60/479,976 filed Aug. 18, 2005, the disclosures of both of which are incorporated herein by reference.

FIELD OF THE INVENTION

The present invention relates to armaments and more particularly to reactive and active electric armor systems.

BRIEF DESCRIPTION OF PRIOR DEVELOPMENTS

The prior art discloses a number of various arrangements of active armor in which a medial layer is positioned between an outer and an inner armor layer with a medial explosive or non-explosive layer that is designed to disrupt a shaped charge to prevent penetration of the overall armor system.

It has previously been suggested that performance of active armor may be improved by providing a medial space between an outer and an inner armor layer and providing an electrical generator to create an electric or magnetic field in this medial space between the outer and inner armor layers that would disrupt a shaped charge gas jet to prevent armor penetration. U.S. Pat. No. 6,758,125 discloses an active armor system, which includes first and second armor layers with an interior space interposed therebetween and a third layer, preferably positioned adjacent to and on the inner side of the first layer, that is comprised of a piezoelectric material, an electrostrictive material, or a magnetostrictive material. The third layer is selected so as to be capable of producing an electrical or magnetic field within the space in response to the application of mechanical force on this third layer. The application of force on the third layer as a result of impact of a shaped charge projectile on the first armor layer is alleged to produce an electric or magnetic charge in the interior space that will disrupt the formation of the shaped charge gas jet so as to prevent the penetration of the second armor layer.

The results of such prior art constructions have not been satisfactory, so a need exists for an efficient active armor system in which an electrical field may be provided in a space exterior of a vehicle armored hull which is capable of protecting the hull against multiple incoming projectiles.

SUMMARY OF THE INVENTION

In one aspect, the invention provides an active armor system comprising at least two electrode plates wherein at least one of the electrode planes is constructed to be self-clearing. In another aspect, the invention provides an active armor system comprising inner and outer generally equidistantly spaced apart electrode plates and electrically joined to one of said plates a plurality of electrical conductors located between said two plates and that can provide an electrical connection between said plates for the purpose of effecting early initiation of current flow in the system. In a further aspect, the invention provides an active armor system which comprises an outer electrode, a group of individual panels arranged to constitute an inner electrode spaced from said outer electrode, a plurality of individual energy storage capacitors distributed throughout the system and connected to said individual panels, and self-clearing tabs which connect said individual capacitors to said outer electrode.

BRIEF DESCRIPTION OF THE DRAWINGS

FIG. 2*a* is a schematic representation of the prior art system of FIG. 1 showing its penetration by two different elongated objects that are electrically conductive.

FIG. 2*b* is a schematic representation of an electric armor system embodying various features of the present invention which has also been penetrated by two elongated objects that are electrically conductive.

FIGS. 3*a* and 3*b* are fragmentary front views of a self-clearing electrode embodying various features of the invention shown prior to and subsequent to attack by a RPG.

FIGS. 4*a*, 4*b* and 4*c* are views similar to FIG. 3*a* illustrating alternative embodiments of such electrodes incorporating various features of the invention.

FIG. 5*a* is a schematic view of an electric armor system generally similar to that shown in FIG. 2*b* which incorporates an optional feature that promotes early initiation of current flow.

FIGS. 5*b* and 5*c* are similar views to FIG. 5*a* which show the system of FIG. 5*a* at the time of attack by a RPG and subsequent thereto.

FIGS. 6*a*, 6*b* and 6*c* are fragmentary front views taken respectively along the lines A-A of the respective FIGS. 5*a*, 5*b* and 5*c*.

FIGS. 7*a*, 7*b* and 7*c* are schematic illustrations of an alternative embodiment of an early initiation system generally similar to that shown in FIGS. 5*a*, 5*b* and 5*c*, with FIG. 7*a* being a fragmentary side view, FIG. 7*b* being a fragmentary perspective view, and FIG. 7*c* being an isometric front view of an electrode embodying various features of the present invention.

FIGS. 8*a*-8*c* are views of another alternative embodiment of a self-clearing electrode for use in an active armor system wherein a plurality of independent capacitors are respectively carried on adjacent panels on an electrode of the type generally shown in FIG. 5*a*, with FIG. 8*a* being an assembled view of one such capacitor assembly, FIG. 8*b* being an exploded perspective view thereof and FIG. 8*c* being a fragmentary perspective view of a portion of the electrode.

DETAILED DESCRIPTION OF THE PREFERRED EMBODIMENTS

Figure 1:
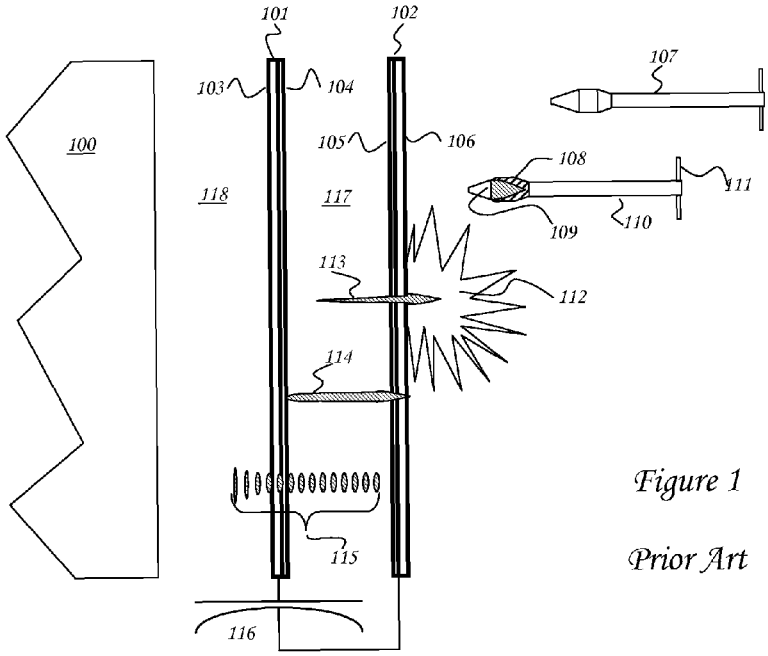
Figure 1 Prior Art
FIG. 1 is a schematic representation of a prior art electric armor system shown in association with an incoming rocket-propelled grenade (RPG).

The basic concept of electric armor is shown in FIG. 1. The hull of an armored vehicle 100 is protected from an incoming rocket-propelled grenade (RPG) 107 by two composite armor electrode layers which include electrodes 104 and 105 that are connected to an energy storage device, such as a capacitor 116. In practice and prior art, the energy storage capacitor 116 is part of a pulse forming network complete with a charging power supply that is designed to defeat the threat. The electric armor electrodes 104 and 105 are mounted via non-conducting members 103 and 106 that provide mechanical structural support for the electrodes and electrical insulation from the other parts of the vehicle when required. The combination of an electrode and its associated member, which may be of a non-conducting ceramic, like alumina, or may be armor sheet material, e.g. aluminum or steel, with an electrically insulating layer or the like, constitute the inner and outer composite electrodes 101 and 102 of the electric armored system.

An RPG is typically made up of several individual parts including a rocket motor 110 and stabilizing fins 111. The business end of the RPG generally consists of a copper cone 109 and a shaped charge 108. On impact with the outer wall of the vehicle 106, the shaped charge detonates (see 112) transitioning the copper cone 109 into a gas-jet or plasma penetrator 113 that penetrates the armor.

Once the extended plasma penetrator 114 stretches out such that it electrically connects the two electrodes 104 and 105, the energy stored in the capacitor 116 is discharged through the plasma. This electrical discharge effectively breaks up the plasma 115 that is directed toward the vehicle hull 100 and has come in contact with the inner electrode 103. The military utility of electric armor stems from the observation that the damage done to the hull by such a broken-up plasma is significantly less than the damage that would be done by the original plasma penetrator, allowing the hull to withstand the RPG hit.

There are two open regions in a typical set of active armor panels. The first is the active space 117 area between electrodes 104 and 105 where the plasma jet or projectile is being broken-up. During the breaking-up process, a blast of high pressure is felt in this region. The second open region is the drift space 118 where the broken-up and disoriented plasma is allowed to expand.

As shown in the cross section of an active armor system in FIG. 2, it may be possible to penetrate the relatively thin active armor layers 101 and 102 with an object 200 that is not a plasma. If such an object 200 is an electrical conductor, it will short out the active armor electrodes 104 and 105 and thus prevent the active armor system from continuing to function as intended. If a capacitor is charged up and connected to such a shorted-out electric armor system, the capacitor will simply discharge through the non-plasma conductor 200. This effectively disables the electric armor system in the sense that the plasma penetrator produced by a subsequent incoming RPG would not be broken-up by the active armor system that is in the state shown in FIG. 2*a*.

It has been found that this performance shortcoming is overcome by the use of structures embodying features of applicant's invention, which may be termed a self-clearing electrode system. Shown in FIG. 2*b* is one embodiment of such a self-clearing electrode 203. By a self-clearing electrode 203 is meant one which inherently clears away or removes a region of the electrode in the area where the penetrator 200 strikes it. The pulse forming network associated with capacitor 116 is designed to produce a pulse that will defeat the threat. The self-clearing electrode is designed to allow this pulse to pass before becoming an open circuit. Typically the self-clearing electrode will open circuit at a current zero. This thus effectively removes the short circuit that would otherwise occur between electrodes 203 and 105, and as a result, the circuit is able to charge up normally and be ready to defeat the next RPG that might attack the vehicle.

FIGS. 3*a* and *b* are fragmentary sectional views of this one embodiment of an electric armor self-clearing electrode 203 in which small individual panels 301 are interconnected to one another via fusible links 300. Individual ones of these panels 301 are hereinafter referred to as numbers 302 and 303 for explanation of operation. These panels 301 would be made of conducting material, e.g. aluminum or conductive polymeric material and might be, e.g., 3 to 6 inch squares. They could be mounted in an insulating frame that would mechanically support them and electrically insulate them from one another. Alternatively they could be suitably adhered to an overall sheet 103 of insulating material as depicted in FIG. 1.

FIG. 3*a* shows the self-clearing electrode 203 before an event, and FIG. 3*b* shows the electrode after an event. If a plasma jet should penetrate the electrode 203 in the region of the panel 301 which is labeled 302 and also penetrate an electrode 105 at a different voltage, current would flow through the plasma jet, causing the capacitor bank 116 to discharge to break up the penetrator jet and at the same time blowing the fuse links 300 in the immediate area of the penetration which is labeled "P" in FIG. 3*b*. In the configuration shown, each of the four fuse links connected to panel 302 will carry approximately ¼ of the current that flows through the plasma jet. The panels 300 adjacent to panel 302 have been labeled 303. The fuse links associated with panels 303 and other contiguous panels will carry less current than the fusible links associated with 302, and all may not blow; however, in FIG. 3*b*, all of the links associated with panels 302 and the 8 surrounding panels 303 are shown as blown.

The self-clearing event is not important if the object bridging between electrodes 104 and 105 is a plasma jet since the plasma jet is naturally self-clearing, i.e. it dissipates. If however, the penetrating object is a solid conductor 200, the self-clearing of the electrode will prevent the permanent shorting of active armor electrodes and allow the electric armor system to recharge and rearm in anticipation of another event. Either of the electrodes or both of the electrodes can be self-clearing in order to achieve the desired effect of preventing such a short circuit. It is anticipated that such a system to protect against RPGs or the like would include a capacitor bank of at least about 5 kilojoules, preferably at least 10 kilojoules and more preferably at least about 100 or more kilojoules. If all of the fusible links are not blown automatically at the time of the destruction of the plasma jet, the operator will simply discharge the charged capacitor bank 116 which will destroy fuses at any point of remaining short circuit.

FIGS. 4*a, b* and *c* show three different structural configurations using fusible links 300 and panels 401, 402 and 403 of various shapes in combination to provide other embodiments of self-clearing electrodes. FIG. 4*a* shows hexagon-shaped panels 401 with one fuse link 300 between each panel and the next adjacent panel. FIG. 4*b* shows triangular panels 402 arranged as composite hexagons with two fuse links 300 between each panel and the panel 402 in the next adjacent hexagon. Panels 403 are shown in FIG. 4*c* which are interconnected with three fusible links 300 that are spread wide apart to the next adjacent panel. Placing the three fusible links 300 relatively wide apart reduces the inductance associated with the interconnection of the panels 403 through the fusible links 300.

The fusible links in FIG. 4 could be individual elements, such as those disclosed in U.S. Pat. Nos. 4,123,738 and 4,150,353 to Huber and Huber et al. Using this type of link has the advantage that it is relatively easy to build a melt point into the link. Should a conducting penetrator short out electrodes 104 and 105 while the system is not energized, the system can be energized at low power forcing current through the fusible links near the point of penetration and causing those links to preferentially melt open. The fusible links could be a thin wire mesh of fusible elements upon which the panels are placed. Another possibility is to have a continuous self-clearing electrode rather than specific fusible links. With a continuous self-clearing electrode, the electrode would burn back an adequate distance from the closest conductor so that, on subsequent operation, there would not be a short circuit between electrodes 104 and 105 even though a conductive projectile is stuck between the panels 101 and 102. The general requirement would be for the fuse element or continuous self-clearing electrode, to melt or vaporize or become a non-conductor, e.g. turning from a conductor like aluminum to an insulator like aluminum oxide, during the event.

In an electric armor system like that of FIG. 1, it is advantageous to initiate the flow of current as quickly as possible so that the plasma jet 114 is broken-up as far from the hull or of the vehicle as possible, thus minimizing the damage inflicted by the round. Initiating the flow of current through the plasma jet well before the tip of the jet reaches the inner electrode 104 or 203 increases the effectiveness of the system. There is some inherent delay in the flow of current from the capacitor 116 to the plasma jet 114 due to the inductance of the system. In practice, this delay limits the types of rounds against which the electric armor is particularly effective. However, it has been found that this situation can be improved by initiating the flow of current before the plasma jet 113 reaches the second or inner electrode 104.

FIG. 5*a* shows an inner composite electrode 101 that includes a self-clearing electrode 104 which may be any of the types shown. The FIG. 3*a* panels are illustrated to which elongated electrical conductors which serve as current flow initiators 500 have been added to the electrode so as to extend into the space 117 toward the outer composite electrode 102. The conductors have limited current carrying capability and are preferably conical, resembling thin metal spikes, and are essentially parallel to one another. In addition, a network 501 of thin initiator wire mesh 501 of metal or other conductive filaments has been added to the tip ends of the initiators 500. When a penetrator penetrates the outer composite electrode 102 at region 502 and then bridges the gap between it and the initiators 500 or initiator wires 501, as shown in FIG. 5*b*, the electrical circuit will be completed, and current will start to flow even though the penetrator jet 113 has not yet reached the second inner composite electrode 101. This early initiation of current flow substantially improves the effectiveness of the active armor system. Once a large amount of current flows through the initiator 500 and initiator network 501, they will be vaporized at region 502, but they will leave behind a plasma that will maintain the electrical connection until a current zero is reached in the circuit. When current zero is reached, the self-clearing electrode may have the appearance shown in FIG. 5*c*, where the fusible links 300, the initiators 500 and the initiator network 501 in the immediate area 502 of the hit have melted and become open-circuited. Even if the remnants of a solid electrically-conducting penetrator 200 should remain at the point of the hit in the region 502 of the self-clearing electrode and the opposite electrode, the electrical circuit will remain open-circuited, so that the system will still be able to rearm for the next event.

The initiator network 501 of FIG. 5 could be configured in a number of different ways and still perform the same function of providing better coverage for the electrical path for early ignition of the flow of current in the circuit. FIGS. 7 *a, b* and *c* show one variation of such a network where a series of thin electrically conductive plates 701 are connected to initiator conductors in the form of posts 500 which protrude from the solid conductor panels 301 which plates are interconnected by the fusible elements 300. A similar effect can be obtained by having a thin solid sheet of conducting material as the initiator network, localized regions of which will vaporize in the localized area of the strike after establishing the plasma that will initiate the early flow of current. In a further embodiment, a thin sheet of conductive material not greater than about 0.25 inch thick can be used as the primary electrode (affixed to an insulating support sheet 103); the material at such thickness will locally vaporize under the plasma jet and/or capacitor discharge. A thin aluminum film of about 5 to 20 microns or an indium tin oxide film of about 2 to 5 microns are examples.

FIGS. 8*a, b* and *c* show a modular approach to capacitor energy storage as a part of an active armor system with a self-clearing electrode. FIG. 8*b* shows an exploded view of the module 800 which is illustrated in FIG. 8*a* for use in an embodiment of an electric armor system. The module incorporates many of the elements described above, including an electrode panel 301, four fusible links 300, and multiple initiators 810. FIG. 8*a* shows the assembled module. In this embodiment of the concept, one electrical terminal of capacitor 801 is physically and electrically connected to panel 301 that forms a part of a self-clearing electrode that is mounted as part of composite inner electrode 101. The second terminal of the energy storage capacitor 801 is connected to the other composite electrode 102 (not shown in FIG. 6*c*) via a thin metal tab 803. The tab 803 is designed to adequately carry the discharge current of a single capacitor (which may be of about 5 joules to 10 kilojoules), but to vaporize if high current associated with the incoming penetrator event should attempt to flow through the tab. In this manner, the electric armor system will clear the tab from the event with the system suffering only a small loss of capacitance. Alternatively, the capacitor 801 could be disposed on the opposite surface of the conductor panels 301, with insulated tabs connections being routed between adjacent panels.

Figure 9:
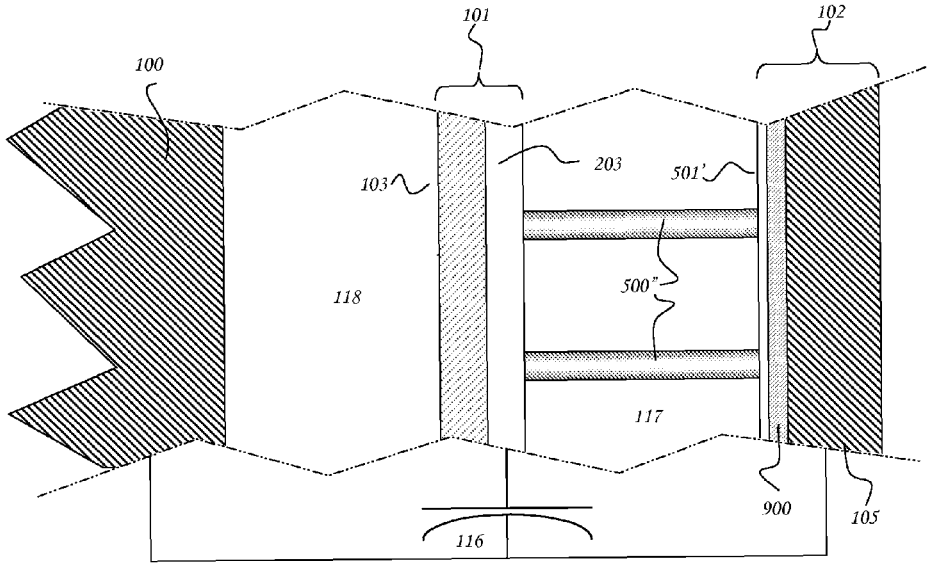
FIG. 9 is a schematic view, similar to FIG. 5*a*, of an alternative embodiment of an active armor system designed to promote early initiation of current flow.

The early initiation of current flow offers an advantage to electric armor systems. FIG. 9 shows another configuration that accomplishes this by moving a thin initiator network 501' very close to the outer electrode 105, separated only by a thin insulator layer 900. The insulated initiator network layer 501' will operate at the same voltage as the energy storage capacitor 116. The thin initiator network 501' is a thin conductive layer that, in one preferred embodiment, is an aluminum film or ITO that has been vapor-deposited onto the surface of the insulator 900 to a thickness of e.g. about 200 angstroms to 1 or 2 microns so that it becomes a physical part of the composite outer electrode 102. This thin network 501' is connected to a self-clearing electrode 203 through initiator posts 500". On initial impact of a projectile or a plasma jet, the initiator posts 500" and the thin initiator network 501' are designed to initiate flow of current in the region of the incoming projectile or jet and focus the electrical discharge in the area of the plasma jet by increasing in impedance as the jet or projectile passes. The result is the provision of an open circuit between the remaining parts of the self-clearing electrode 203 and the outer electrode 105, which in this embodiment is electrically connected to the hull of the vehicle 100.

In all these systems, the self-clearing electrode 203 is electrically insulated from the hull 100 and from the outer electrode 105 by an insulating structural member 103. In a preferred embodiment, the construction of the overall support system would be flexible, in the sense that the various components of the electric armor system, i.e. the inner and outer electrodes, would be allowed to move or flex in relation to the hull and other components of the system.

Although the invention has been described with regard to certain preferred embodiments, which constitute the best mode presently known to the inventor, it should be understood that changes and modifications may be made to these illustrated embodiments as would be obvious to one having ordinary skill in this art, without departing from the scope of the invention which is defined in the claims appended hereto. For example, although aluminum, ITO, copper and conducting polymers have been mentioned as conductive materials that may be employed, it should be understood that other conductive materials, as well known in this art, could be alternatively used.

The disclosure of the U.S. patent mentioned herein is expressly incorporated herein by reference.

Particular features of the invention are emphasized in the claims that follow.

The invention claimed is:

1. An active armor system for a vehicle, which system comprises an outer electrode, a group of individual panels arranged to constitute an inner composite electrode spaced from said outer electrode by an open region, non-conducting members that provide electrically insulated mechanical support from the vehicle for said inner and outer electrodes with said inner electrode spaced from the vehicle by a second open region, a plurality of individual energy storage capacitors distributed throughout the system and connected to said individual panels of said inner composite electrode, and fusible tabs connecting each of said individual capacitors to said outer electrode.

2. The active armor system of claim 1 wherein each of said individual panels is connected by multiple fusible links to adjacent panels in said inner electrode.

3. The active armor system of claim 1 wherein each individual panel carries a plurality of metal spikes which extend toward said outer electrode.

4. The active armor system of claim 1 wherein said capacitors have a storage capacity of not greater than 10 kilojoules and said fusible tabs are formed to vaporize when subjected to a current greater than the discharge current of a 10 kilojoule capacitor.

5. An active armor system for a vehicle comprising inner and outer generally equidistantly spaced apart electrode plates which are separated by an open region, non-conducting members that provide mechanical support for the electrode plates and allow their electrically insulated support spaced from the vehicle by a second open region, one of said electrode plates being a composite plate formed of a plurality of individual conductive panels with fusible links interconnecting said panels, a plurality of individual energy storage capacitors connected to said individual panels, and fusible electrical conductors located between said two plates and electrically connecting each of said capacitors to the other of said electrode plates.

6. The active armor system of claim 5 wherein each of said individual panels is connected by multiple fusible links to adjacent panels in said composite electrode.

7. The active armor system of claim 5 wherein each individual panel carries a plurality of metal spikes which extend toward said other electrode.

8. The active armor system of claim 5 wherein said capacitors have a storage capacity of not greater than 10 kilojoules and said fusible tabs are formed to vaporize when subjected to a current greater than the discharge current of a 10 kilojoule capacitor.

9. An active armor system for a vehicle, which system comprises an outer electrode, a group of individual panels connected by multiple fusible links to adjacent panels and arranged to constitute an inner composite electrode, non-conducting members that provide electrically insulated mechanical support from the vehicle for said inner and outer electrodes and which space said inner electrode from the vehicle by an open drift region and space said panels substantially equidistantly from said outer electrode to provide an open active region, a plurality of individual energy storage capacitors distributed in said active region and connected to said individual panels of said inner composite electrode, and fusible tabs connecting each of said individual capacitors to said outer electrode.

10. The active armor system of claim 9 wherein each said individual panel carries a plurality of metal spikes which extend toward said outer electrode.

11. The active armor system of claim 9 wherein said capacitors each have a storage capacity of not greater than 10 kilojoules and wherein said fusible tabs are formed to vaporize when subjected to a current greater than the discharge current of a 10 kilojoule capacitor.

* * * * *